US005954422A

United States Patent [19]

Marchini et al.

[11] Patent Number: 5,954,422

[45] Date of Patent: Sep. 21, 1999

[54] ILLUMINATED SLOT MACHINE WITH DRIVE ASSEMBLY WITH MOVEABLE ROLLER SUPPORT

[75] Inventors: Barry Allen Marchini, West Sussex; Robert Alan Holmes, Surrey, both of United Kingdom

[73] Assignee: Starpoint Electrics Limited, West Sussex, United Kingdom

[21] Appl. No.: 08/836,181

[22] PCT Filed: Oct. 31, 1995

[86] PCT No.: PCT/GB95/02552

§ 371 Date: Apr. 23, 1997

§ 102(e) Date: Apr. 23, 1997

[87] PCT Pub. No.: WO96/13816

PCT Pub. Date: May 9, 1996

[30] Foreign Application Priority Data

| | | | |
|---|---|---|---|
| Oct. 31, 1994 | [GB] | United Kingdom | 9422020 |
| Dec. 6, 1994 | [GB] | United Kingdom | 9424623 |

[51] Int. Cl.[6] ..... F21V 21/14

[52] U.S. Cl. ..... 362/227; 362/320; 362/418; 353/109; 474/150; 474/204

[58] Field of Search ..... 353/109; 273/142 R, 273/143 R, 143 B; 474/148, 149, 150, 153, 204; 362/227, 320, 418; 463/20

[56] References Cited

FOREIGN PATENT DOCUMENTS

| | | | |
|---|---|---|---|
| 0 066 985 A1 | 12/1982 | European Pat. Off. | G07F 17/34 |
| 2 068 620 | 8/1981 | United Kingdom . | |
| 2 150 335 | 6/1985 | United Kingdom . | |
| WO 94/17500 | 8/1994 | WIPO . | |

*Primary Examiner*—Sandra O'Shea
*Assistant Examiner*—Marshall Honeyman
*Attorney, Agent, or Firm*—Sughrue, Mion, Zinn, Macpeak & Seas, PLLC

[57] ABSTRACT

A drive assembly is constituted by a strip (10) and three or more parallel and rotatable supports (12, 16, 22) around which the strip (10) is wrapped. At least two of the rotatable supports (22) are linked together for common movement, for example by a movable holder in the form of a light box (20) carrying a series of light bulbs (50) while at least one of the rotatable supports (12, 16) is stationary.

18 Claims, 6 Drawing Sheets

ILLUMINATED SLOT MACHINE WITH DRIVE ASSEMBLY WITH MOVEABLE ROLLER SUPPORT

The present invention relates to drive assemblies and is especially, but not exclusively, concerned with drive assemblies for use with gaming machines, sometimes referred to as fruit machines or amusement machines.

It is well known for gaming machines to include a number of adjacent reels marked around their circumferential surfaces with symbols such as fruit. During play, the reels are caused to spin about a common axis by pulling on a handle or pressing a button. When the reels come to a standstill, the positions of the symbols on the different reels in relation to one or more predetermined lines decide whether or not a player has won.

Each of the reels is typically formed from a strip presenting the symbols and a drum-like support carrying the strip.

Recently, it has been proposed that each of the reels can take the form of a plurality of parallel and rotatable supports around which a strip is wrapped.

For example, International patent application no. PCT/GB 94/00139 (WO 94/17500) discloses a drive assembly in which there are three rotatable supports extending between and located at the respective corners of a pair of generally triangular non-rotatable supports. An electrical stepper motor or other drive means rotates only one of the rotatable supports, which thus positively moves the strip wrapped therearound whilst the other two rotatable supports merely idle, in order to bring symbols presented by the strip into successive view through one or more windows or other inspection means. Moreover, said International patent application no. PCT/GB 94/00139 (WO 94/17500) discloses that the two rotatable supports which merely idle are spring-mounted relatively to the non-rotatable supports in directions intended to ensure that the strip wrapped therearound is correctly tensioned.

To remove the strip, it is necessary in practice for both of the two rotatable supports which merely idle to be physically moved to compress their respective springs. Typically, a spring-mounting is provided in which two plates are formed with small holes which are normally out of alignment, but which can be moved into alignment against the pressure of a restoring force, and then kept in alignment by insertion of a matchstick through the small holes. This can be awkward, particularly when each of the two rotatable supports which merely idle is provided with one of the spring-mountings at each of its ends.

According to the present invention, however, a drive assembly comprises a strip and three or more parallel and rotatable supports around which the strip is wrapped, characterised in that at least two of the rotatable supports are linked together for common movement whilst at least one of the rotatable supports is stationary.

Preferably, said at least two of the rotatable supports are associated with a common movable holder and said at least one of the rotatable supports are associated with a common stationary holder.

The movable holder may be curved at a region over which the strip is to pass and said curved region of the movable holder may be provided with a series of circumferentially-spaced rotatable supports of relatively small diameter.

In contrast, the stationary holder may be straightsided at all regions over which the strip is to pass. The stationary holder may, for example, be of generally quadrilateral outline, with a series of rotatable supports of relatively large diameter being located at respective ones of its corners. In such a manner, it is possible for space to be saved whilst maintaining a traditional curved display for the strip.

The movable holder may be in the form of a light box carrying light bulb(s) or other illumination means and said light bulb(s) or other illumination means may be located in region(s) between respective adjacent pair(s) of said rotatable supports of said movable holder.

It is particularly advantageous for the movable holder to be in the form of a light box carrying illumination means in terms of ease of manufacture and ease of assembly. When the light box has a curved region over which the strip passes, the illumination means can be located nearer to said curved region than would otherwise be the case. This not only avoids wastage of space but allows better and more uniform illumination of the strip by the illumination means. Moreover, especially when the light box is formed of a plastics material, the circumferentially-spaced rotatable supports can simply snap fit with the light box. Even though the light box is movable between an extended condition and a retracted condition, such movement can be taken up by slack in electric wiring connected to the illumination means.

In a particularly preferred drive assembly, there are six rotatable supports in said first plurality of said rotatable supports, five light bulbs located therebetween, and four of said rotatable supports in said second plurality of said rotatable supports.

Preferably, the movable holder is spring-mounted relatively to the stationary holder—the arrangement can be such that either the movable holder is continuously urged away from the stationary holder to an extended condition or the movable holder is continuously urged towards the stationary holder to a retracted condition.

It is desirable for a pair of compression springs to be provided for continuously urging the movable holder towards its extended condition relatively to the stationary holder.

It will be appreciated that, to loosen the strip in order to release the strip from for example a sprocket drive for the strip, it is merely necessary to move the movable holder from its extended condition to its retraction condition relatively to the stationary holder, such as by simple pushing.

It is desirable, but not necessary, for a latching mechanism to be provided for retaining the movable holder in its retracted condition relatively to the stationary holder until the latching mechanism has been released.

Preferably, a positive gear drive is provided between drive means and one of the rotatable supports which is to be driven by the drive means. Said driven one of the rotatable supports may have a series of studs for positive location with apertures in the strip and may also have a series of gear teeth for positive location with a gear wheel driven by the drive means. It is also preferred for the gear wheel and the drive means to be connected by a flexible shaft coupling.

Several drive assemblies, in accordance with the present invention, will now be described in greater detail, by way of example only, with reference to the accompanying drawings, in which.

Figure 1:
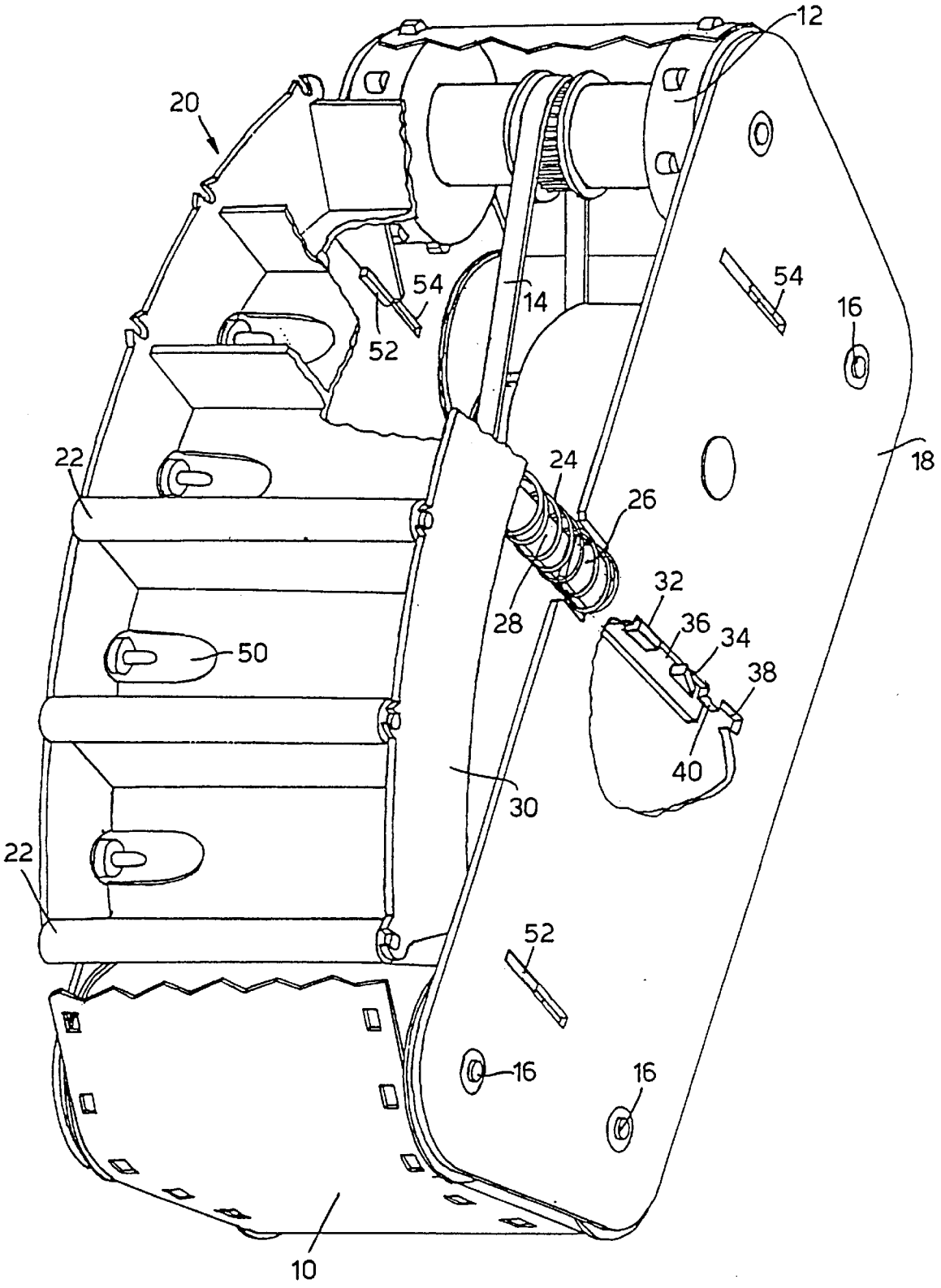
FIGS. 1 to 5 are schematic fragmentary perspective views of different drive assemblies according to the present invention.

All of the present drive assemblies have a number of features which are not only common to one another but are common to the drive assemblies of International patent application no. PCT/GB 94/00139 (WO 94/17500).

Thus, each of the present drive assemblies may include:

an apertured strip 10 arranged in a continuous loop and provided with symbols (not shown);

a studded drive roller 12 driven by conventional drive means including a belt 14 and an electric stepper motor;

three non-studded idler rollers 16; and a pair of trapezoidal plates 18 to which all of the rollers 12 and 16 are rotatably mounted.

Clearly, the belt-drive for the studded roller 12 could be replaced by a positive gear drive, as discussed hereinbelow, and the idler rollers 16 could themselves be studded.

It should be noted that none of the rollers 12 and 16 is individually spring-mounted. Instead, a lamp box 20 is provided with a series of guide rollers 22 spaced apart from one another along a curved outline of the lamp box 20. The lamp box 20 is formed of a plastics material to allow the ends of each of the guide rollers 22 to be snap fitted thereto.

Various arrangements can allow the lamp box 20 to be movable relatively to the plates 18.

As a consequence, the guide rollers 22 (constituting a first plurality of rotatable supports carried by a movable holder) are linked together to move in unison relatively to the drive roller 12 and the idler rollers 16 (constituting a second plurality of rotatable supports carried by a stationary holder).

For convenience, as all of the drive assemblies are substantially symmetrical, only one side will now be described of FIGS. 1 to 5.

In FIG. 1, a compression spring 24 encircles a tongue 26 presented by the plate 18 and also encircles an arm 28 extending from a curved member 30 presented by the lamp box 20. The spring 24 is thus operative to urge the lamp box 20 continuously away from the plate 18. The arm 28 is provided with a pair of projections, shown as a guide 32 and a ratchet 34. The plate 18 is provided with a pair of slots, shown as a long slot 36 and a short slot 38 separated by a bridge 40.

When the lamp box 20 is pressed towards the plate 18, to compress the spring 24, the arm 28 is flexed inwardly to enable the ratchet 34 to pass the bridge 40 and snap into the short slot 38, thereby locking the lamp box 20 in a retracted condition. To release the retracted condition, the ratchet 34 is pressed inwardly, for example by a screwdriver, to flex the arm 28 sufficiently to allow the ratchet 34 to be moved by the spring 24 past the bridge 40 and into the long slot 36. An extended condition is reached, which is the normal condition of use in which the apertured strip 10 is in engagement with the studded rollers 12 and 16, when the guide 32 abuts an adjacent end of the long slot 36.

Figure 2:
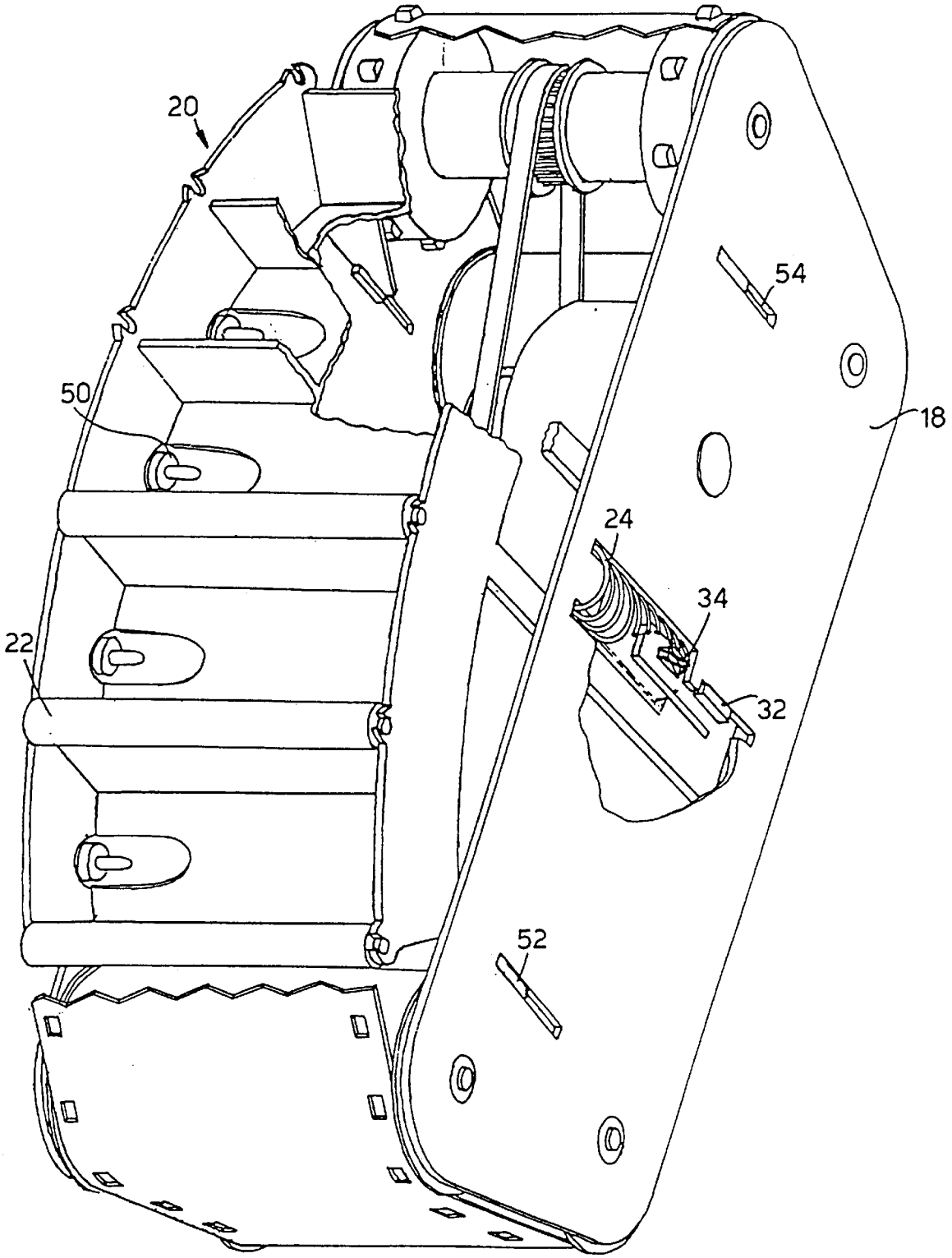
Figure 3:
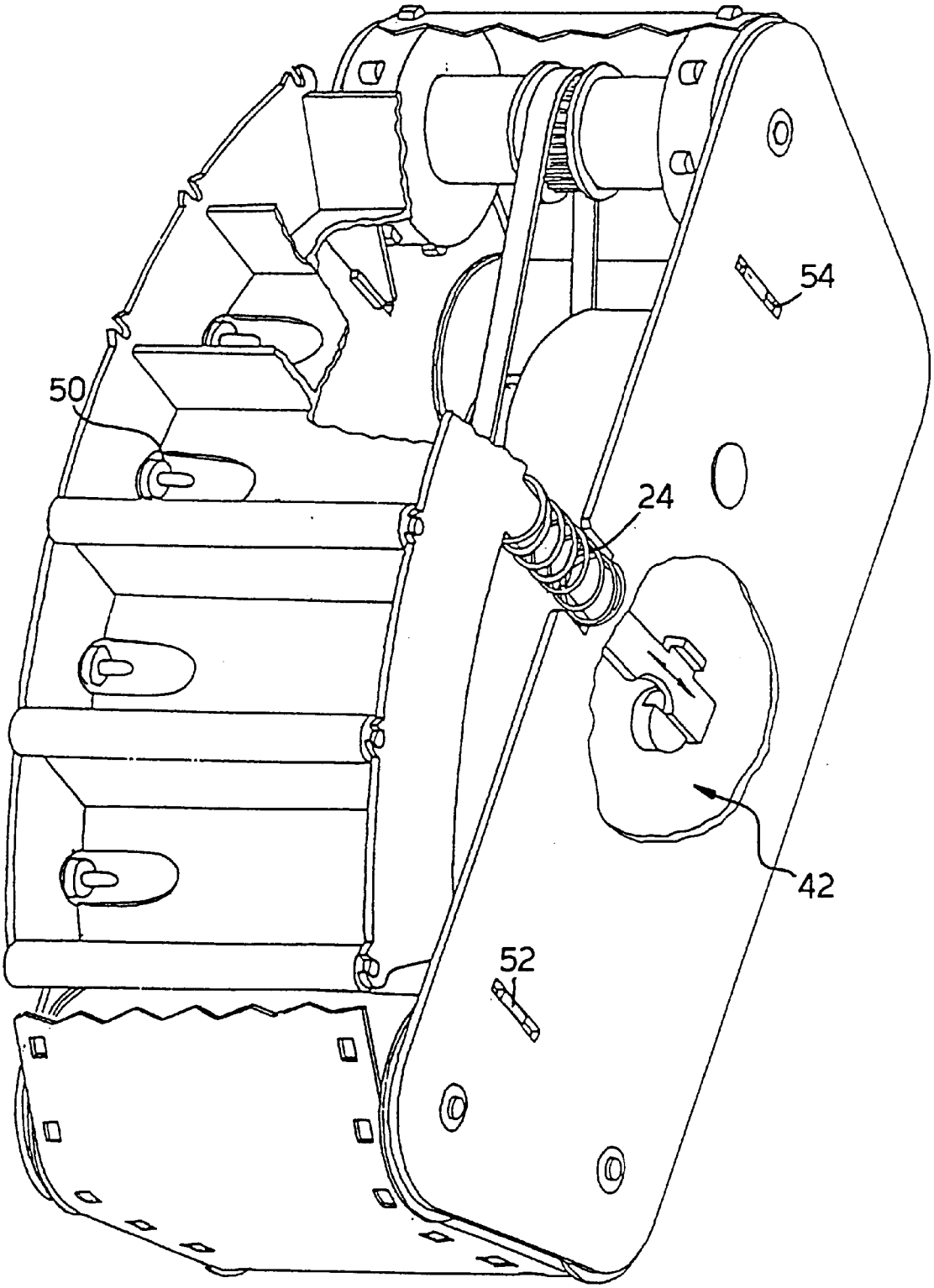
Figure 4:
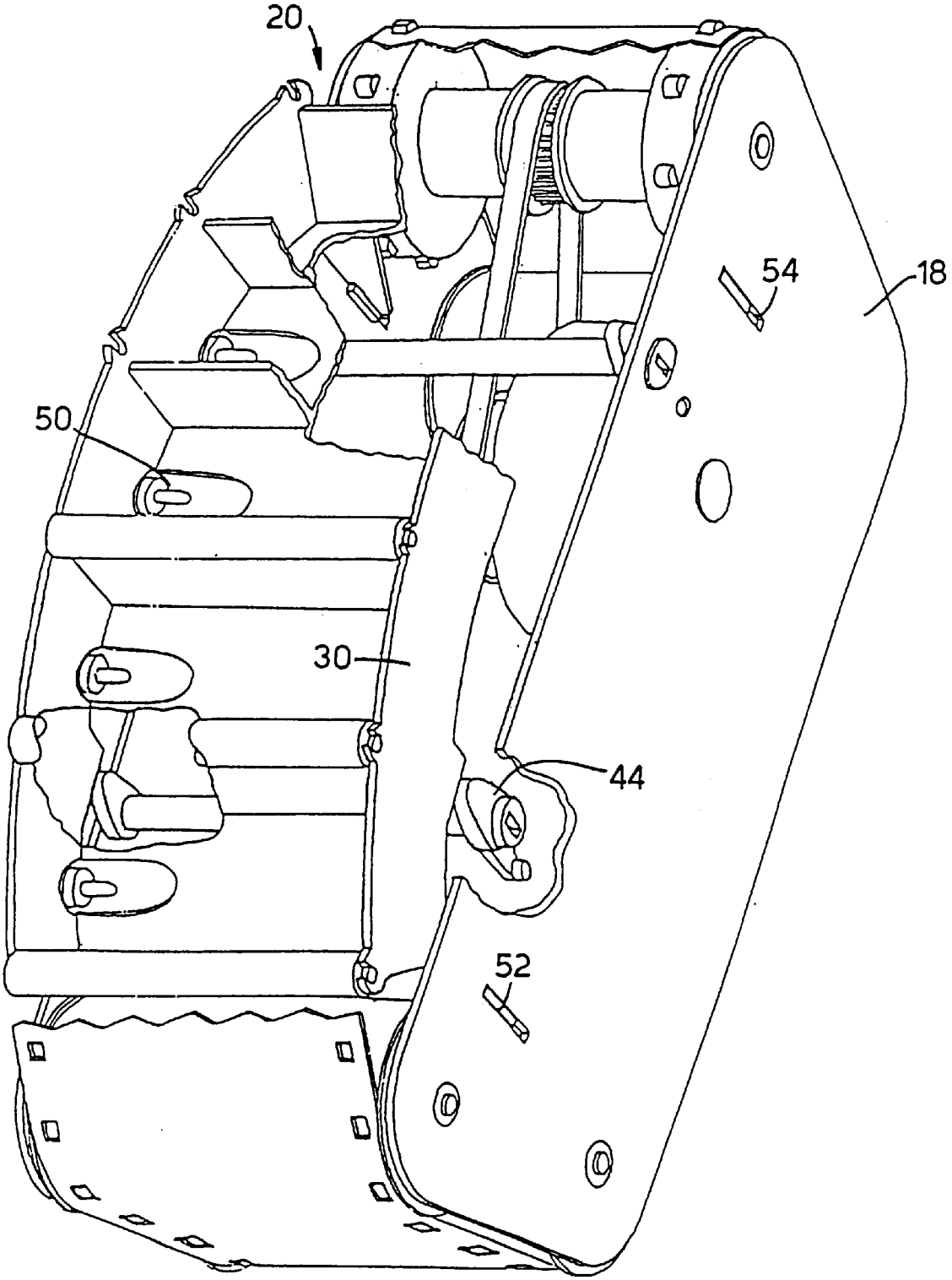
Figure 5:
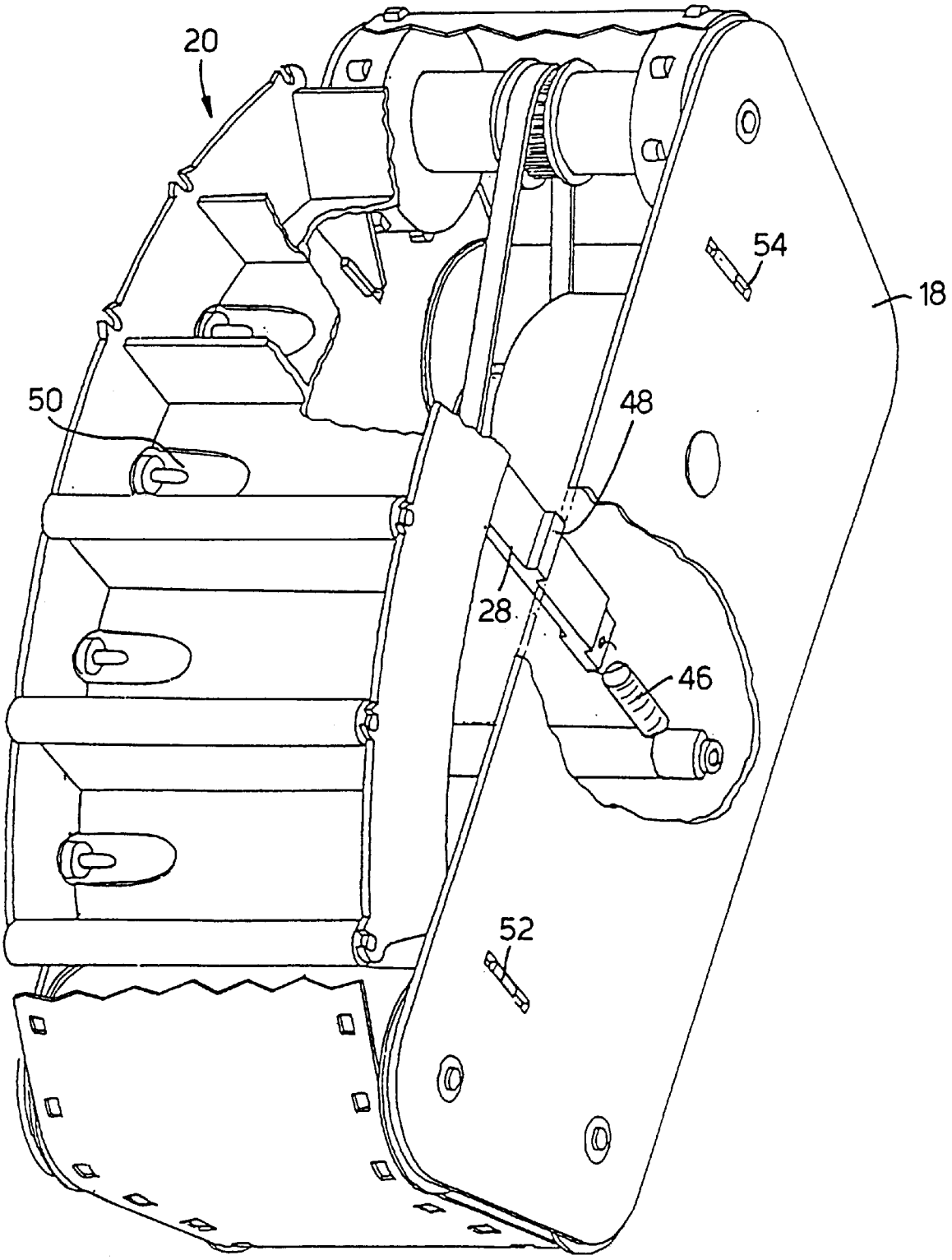

In FIG. 2, which is similar to FIG. 1, the spring 24 continuously urges the lamp box 20 to its retracted condition and needs to be compressed to allow the lamp box 20 to achieve its extended condition. In FIG. 3, reciprocation of the arm 28 is controlled by a mechanical linkage 42. In FIG. 4, a spring (not shown) continuously pulls the lamp box 20 to its retracted condition, with an eccentric cam 44 being provided to press against the curved member 30. In FIG. 5, which is similar to FIG. 4, a worm thread 46 is provided to control reciprocation of the arm 28, which is provided with an abutment 48 to define the retracted condition.

In other arrangements, a pair of compression springs is provided in a plane lying between, such as centrally between and parallel to, the two trapezoidal plates 18.

All of the five lamp boxes 20 are provided with six of said guide rollers 22, which define between them five illumination regions each provided with a light bulb 50, and all of the lamp boxes 20 are further provided on each side with a pair of guide tabs 52 movable within elongate slots 54.

Figure 6:
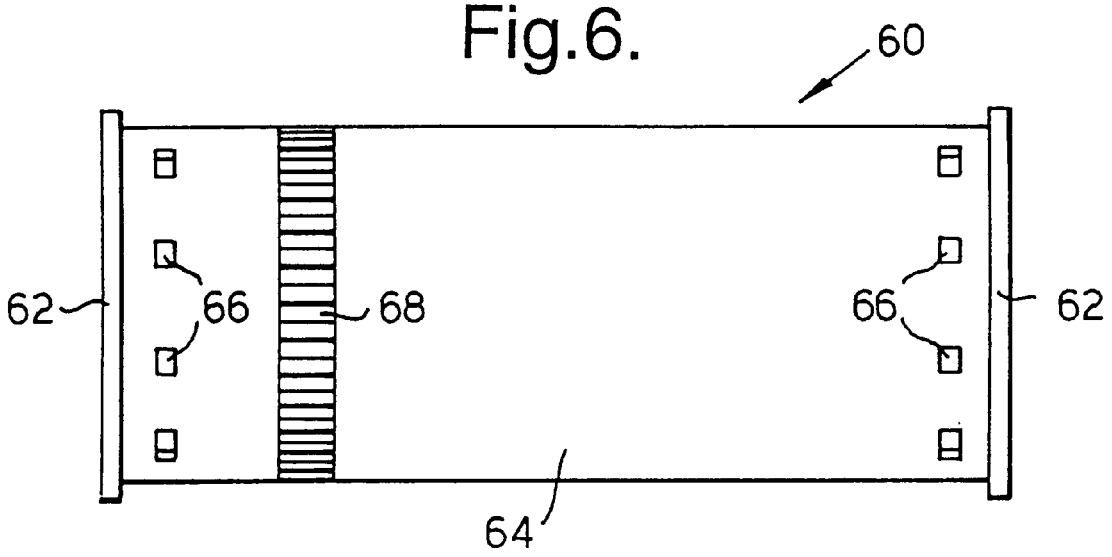
FIG. 6 is a schematic side view of a modified drive roller for use in a drive assembly according to the present invention.

As shown in FIG. 6, a modified drive roller 60 does not include a thin central shaft.

Instead, the drive roller 60 includes a pair of end flanges 62 which are of only slightly greater diameter than a central axle 64. The difference in diameters may be as little as one or two millimeters. The central axle 64 is formed with two series of conventional circumferentially spaced studs 66 either one of which could be omitted. The central axle 64 is also formed with a series of gear teeth 68. The outer tips of the gear teeth 68 are co-extensive with the peripheral surface of the central axle 64. More generally, the outer tips of the gear teeth 68 do not protrude radially outwardly beyond the peripheral surface of the central axle 64. Thus, the gear teeth 68 do not stop a symbol-carrying strip from lying snugly against the central axle 64 with apertures in the strip engaging the studs 66. The strip is thus effectively supported across its entire width.

Figure 7:
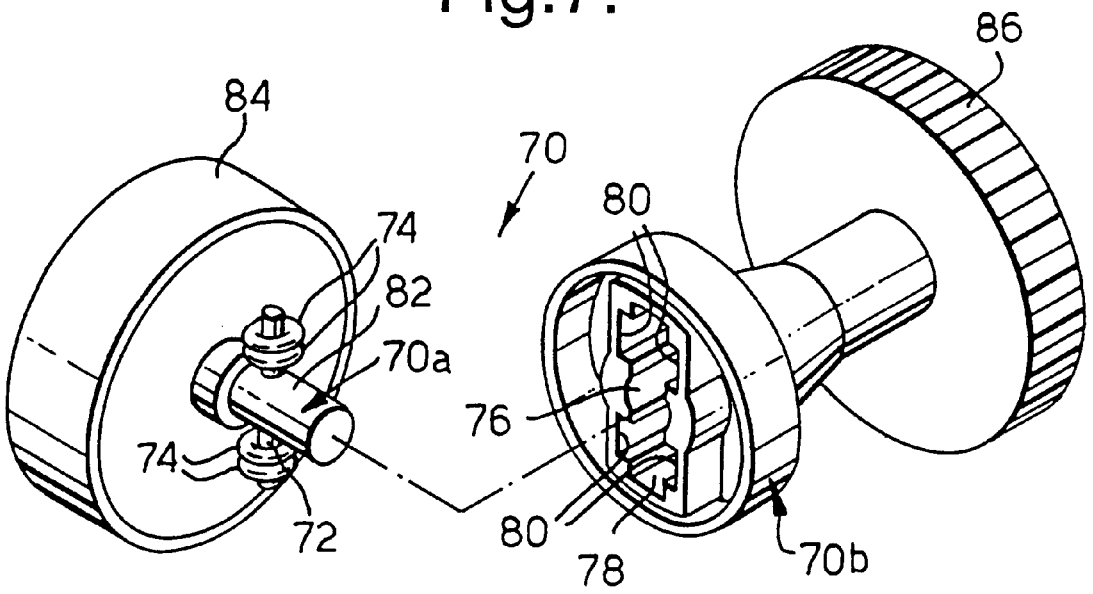
FIG. 7 is an exploded perspective view of a modified flexible shaft coupling for use in a drive assembly according to the present invention.

As shown in FIG. 7, the drive connection from the source of power (electric stepper motor) may include a flexible shaft coupling 70 of the kind described and claimed in our European (UK) patent 0066985, to which the interest reader is instructed to refer.

The flexible shaft coupling 70 comprises a male part 70*a* having radially extending projections 72 each surrounded by a closed ring 74 of resilient material, and a female part 70*b* having an opening 76 formed with a transverse slot 78 and a pair of recesses 80 for the reception of the projections 72 and their rings 74.

More particularly, the male part 70*a* is constituted by the end of a drive shaft 82 from the electric stepper motor 84, the projections 72 are formed by the ends of a pin extending through the drive shaft 82, and each ring 74 of resilient material is in the form of at least one O-ring. The central portion of the opening 76 forms a close fit with the end of the drive shaft 82. The female part 70*b* includes a disc-like gear wheel 86 whose teeth engage with the gear teeth 68 noted in FIG. 1.

Naturally, the flexible shaft coupling 70 needs to be located in a position where the gear wheel 86 does not interfere with the symbol-carrying strip, which is likely to extend around a significant part of the circumference of the drive roller 60.

We claim:

1. A drive assembly comprising:

a strip;

three or more parallel and rotatable supports around which the strip is wrapped, wherein at least two of the rotatable supports are linked together for common movement while at least one of the rotatable supports is stationary;

a common movable holder associated with said at least two of the rotatable supports;

a common stationary holder associated with said at least one of the rotatable supports, wherein the movable holder is spring-mounted for movement between an extended condition and a retracted condition relatively to the stationary holder; and a latching mechanism for retaining the movable holder in its retracted condition relatively to the stationary holder until the latching mechanism has been released.

2. A drive assembly according to claim 1, further comprising drive means for driving one of said rotatable supports as a driven one of the rotatable supports, and a positive gear drive provided between the drive means and said driven one of the rotatable supports.

3. A drive assembly comprising:

a strip;

three or more parallel and rotatable supports around which the strip is wrapped, wherein at least two of the rotatable supports are linked together for common movement while at least one of the rotatable supports is stationary;

a common movable holder associated with said at least two of the rotatable supports; and a common stationary holder associated with said at least one of the rotatable supports;

wherein the movable holder is in the form of a light box which includes illumination means for providing light within the light box.

4. A drive assembly according to claim 3, wherein the movable holder is spring-mounted for movement between an extended condition and a retracted condition relatively to the stationary holder.

5. A drive assembly according to claim 4, wherein a pair of compression springs are provided for continuously urging the movable holder towards its extended condition relatively to the stationary holder.

6. A drive assembly according to claim 4, wherein the stationary holder has a generally quadrilateral outline, and wherein four of said rotatable supports over which said strip passes are located at respective corners of said quadrilateral outline.

7. A drive assembly according to claim 3, wherein the stationary holder has a generally quadrilateral outline, and wherein four of said rotatable supports over which said strip passes are located at respective corners of said quadrilateral outline.

8. A drive assembly according to claim 3, further comprising drive means for driving one of said rotatable supports as a driven one of the rotatable supports, and a positive gear drive provided between the drive means and said driven one of the rotatable supports.

9. A drive assembly according to claim 8, wherein said driven one of the rotatable supports has a series of studs for positive location with apertures in the strip and also has a series of gear teeth for positive location with a gear wheel driven by the drive means.

10. A drive assembly according to claim 9, wherein the gear wheel and the drive means are connected by a flexible shaft coupling.

11. A drive assembly according to claim 8, wherein said driven one of the rotatable supports is such that the strip is effectively supported across its entire width.

12. A drive assembly according to claim 3, wherein the movable holder has a curved region thereon, said rotatable supports being circumferentially-spaced over said curved region.

13. A drive assembly according to claim 12, wherein the circumferentially-spaced rotatable supports are a snap fit with the light box.

14. A drive assembly comprising:

a strip;

three or more parallel and rotatable supports around which the strip is wrapped, wherein at least two of the rotatable supports are linked together for common movement while at least one of the rotatable supports is stationary;

a common movable holder associated with said at least two of the rotatable supports; and a common stationary holder associated with said at least one of the rotatable supports;

wherein the movable holder has a curved region thereon, said rotatable supports being circumferentially-spaced over said curved region.

15. A drive assembly according to claim 14, wherein the circumferentially-spaced rotatable supports are a snap fit with the light box.

16. A drive assembly according to claim 14, wherein the movable holder is in the form of a light box which includes illumination means for providing light within the light box.

17. A drive assembly according to claim 14, further comprising drive means for driving one of said rotatable supports as a driven one of the rotatable supports, and a positive gear drive provided between the drive means and said driven one of the rotatable supports.

18. A drive assembly comprising:

a strip;

three or more parallel and rotatable supports around which the strip is wrapped, wherein at least two of the rotatable supports are linked together for common movement while at least one of the rotatable supports is stationary;

a common movable holder associated with said at least two of the rotatable supports;

a common stationary holder associated with said at least one of the rotatable supports, wherein the movable holder is spring-mounted for movement between an extended condition and a retracted condition relatively to the stationary holder;

a pair of compression springs for continuously urging the movable holder towards its extended condition relatively to the stationary holder; and a latching mechanism for retaining the movable holder in its retracted condition relatively to the stationary holder until the latching mechanism has been released.

* * * * *